US007921584B2

(12) United States Patent
Kestner

(10) Patent No.: US 7,921,584 B2
(45) Date of Patent: Apr. 12, 2011

(54) KINETIC SCULPTURAL SYSTEM AND ASSEMBLY OF INTERCONNECTED MODULES

(76) Inventor: Michael Kestner, Lake Worth, FL (US)

( * ) Notice: Subject to any disclaimer, the term of this patent is extended or adjusted under 35 U.S.C. 154(b) by 261 days.

(21) Appl. No.: 12/263,903

(22) Filed: Nov. 3, 2008

(65) Prior Publication Data

US 2009/0300956 A1 Dec. 10, 2009

Related U.S. Application Data

(60) Provisional application No. 61/058,675, filed on Jun. 4, 2008.

(51) Int. Cl.
*G09F 19/08* (2006.01)

(52) U.S. Cl. ..... 40/411; 273/153 S

(58) Field of Classification Search ..... 40/411, 40/493; 273/153 S

See application file for complete search history.

(56) References Cited

U.S. PATENT DOCUMENTS

| | | | | |
|---|---|---|---|---|
| 1,027,723 | A * | 5/1912 | Hamilton | 211/165 |
| 3,755,936 | A * | 9/1973 | Terre et al. | 40/473 |
| 4,378,117 | A * | 3/1983 | Rubik | 273/153 S |
| 4,427,197 | A * | 1/1984 | Doose | 273/153 S |
| 2004/0100022 | A1 * | 5/2004 | Pasquarelli | 273/153 S |
| 2005/0133994 | A1 * | 6/2005 | Narasimhan | 273/153 S |

* cited by examiner

*Primary Examiner* — Gary C Hoge
(74) *Attorney, Agent, or Firm* — Robert C Kain, Jr.

(57) ABSTRACT

The kinetic sculptural system of interconnected modules has multiple configurable positions (e.g., square or sphere). One system has a central coupler and eight struts each with a pivot element at its distal end. Modules move on the struts radially and rotate 180 degrees in a slotted radial passageway. The slot and radial channel are coextensive. To configure the system, modules are moved outboard, then rotated 180 degrees, the moved inboard as a toy or puzzle or object of art. The kinetic sculptural system can be configured with n struts wherein n is greater than 1 and the central coupler rests upon an imaginary ground plane (such as a hemispheric central coupler rising above a ground plane). Each movable module has a complementary first and second inboard shape and the module shapes complement each other to form a compressed first and second shape.

14 Claims, 11 Drawing Sheets

KINETIC SCULPTURAL SYSTEM AND ASSEMBLY OF INTERCONNECTED MODULES

This is a regular patent application based upon and claiming the benefit of provisional patent application Ser. No. 61/058,675, filed Jun. 4, 2008, the content of which is incorporated herein by reference thereto.

The present invention relates to a kinetic sculptural system and assembly of interconnected modules wherein the user can move and re-configure the assembly.

BACKGROUND OF THE INVENTION

Kinetic sculpture is a form of art or an assembly of items made up of parts designed to be set in motion either by an internal mechanism or external stimulus. The moving parts of a kinetic sculptural assembly may be moved by wind, motor or by the observer.

As such, kinetic sculptural systems may be viewed and constructed as toys or as unique, changeable, objects of art or as puzzles.

OBJECTS OF THE INVENTION

It is an object of the present invention to provide a kinetic sculptural system of interconnected modules.

It is a further object of the present invention to provide a kinetic sculptural system which can be moved to form various shapes by a user.

It is an additional object of the present invention to provide a kinetic sculptural system which can be configured as a toy.

It is a further object of the present invention to provide a puzzle system configured as a kinetic sculptural assembly of modules.

It is an additional object of the present invention to provide a kinetic sculptural system which can be modified by the user to form different unique shapes.

SUMMARY OF THE INVENTION

One embodiment of the present invention is a kinetic sculptural system of interconnected modules having multiple configurable positions. The kinetic system includes a central coupler with a central point. In one embodiment, eight struts are mounted on the central coupler at substantially 90 degree angles with respect to each other. Each strut has a pivot element at its distal end. A movable module is mounted on each strut. Each module includes a radial channel within which is disposed the pivot element of the corresponding strut. Further, each module includes a slotted radial passageway. This slotted radial passageway is formed atop the radial channel and one edge surface of the channel forms one wall of slotted radial passageway. The slot wall and channel wall are coextensive. The slotted radial passageway forms a substantially 180 degree radial slot through the movable module thereby permitting complete 180 degree rotation of the module about this strut in a plane passing through the centerpoint. The 180 degree rotation typically occurs when the pivot element is at the distal terminus of the radial channel. The module rotates 180 degrees about the pivot element with the strut moving 180 degrees through the slotted radial passageway. To configure the sculptural system as a toy or a puzzle (or enhance user interaction), each module can be split apart, each part being detachable with respect to the other, each strut can be detachable from the central coupler, and the central coupler can be made of a plurality of sphere segments which are all detachably interconnected.

Further, the kinetic sculptural system can be configured with n struts wherein n is greater than 1 and the central coupler rests upon an imaginary ground plane (such as a hemispheric central coupler rising above a ground plane). Each movable module, movable on each strut, has a complementary first inboard shape and a complementary second inboard shape. The first inboard shape and the second inboard shape forms, in a first inboard compressed mode, a first substantially solid sphere or hemisphere body (a hemisphere when the kinetic sculpture is on an imaginary ground plane) and, in a second inboard compressed mode, forms a second substantially solid body when all n struts are positioned at a second terminus in their respective channels in the respective module. The module shapes complement each other to form a compressed shape such as a square or an oblong sphere.

As examples, FIG. 1 shows a square kinetic sculptural system whereas FIGS. 4, 6 and 12 show a oblong or spherical kinetic structure.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a kinetic sculptural system which can be an object of art, a puzzle or a toy which includes interconnected modules having multiple configurable positions. Similar numerals designate similar items throughout the drawings and in the specification. The term "inboard" refers to items closer to the centerpoint of the central coupler as compared with other items. Also, the term "radial" refers to imaginary lines which extend outward from the centerpoint of the central coupler. If the central coupler is a hemisphere or a sphere, the centerpoint is the center of the hemisphere or sphere. Please note that although portions of this specification discuss a kinetic sculptural system with eight movable modules, the system can be configured with four movable modules mounted above a central coupler when the coupler is at the centerpoint of an imaginary hemisphere on an imaginary ground plane. Further, other embodiments having different numbers of n struts and n modules are discussed at the end of the specification. At least two struts must be used when the centerpoint is on a ground plane and the struts radially extend from the center point.

Figure 1:
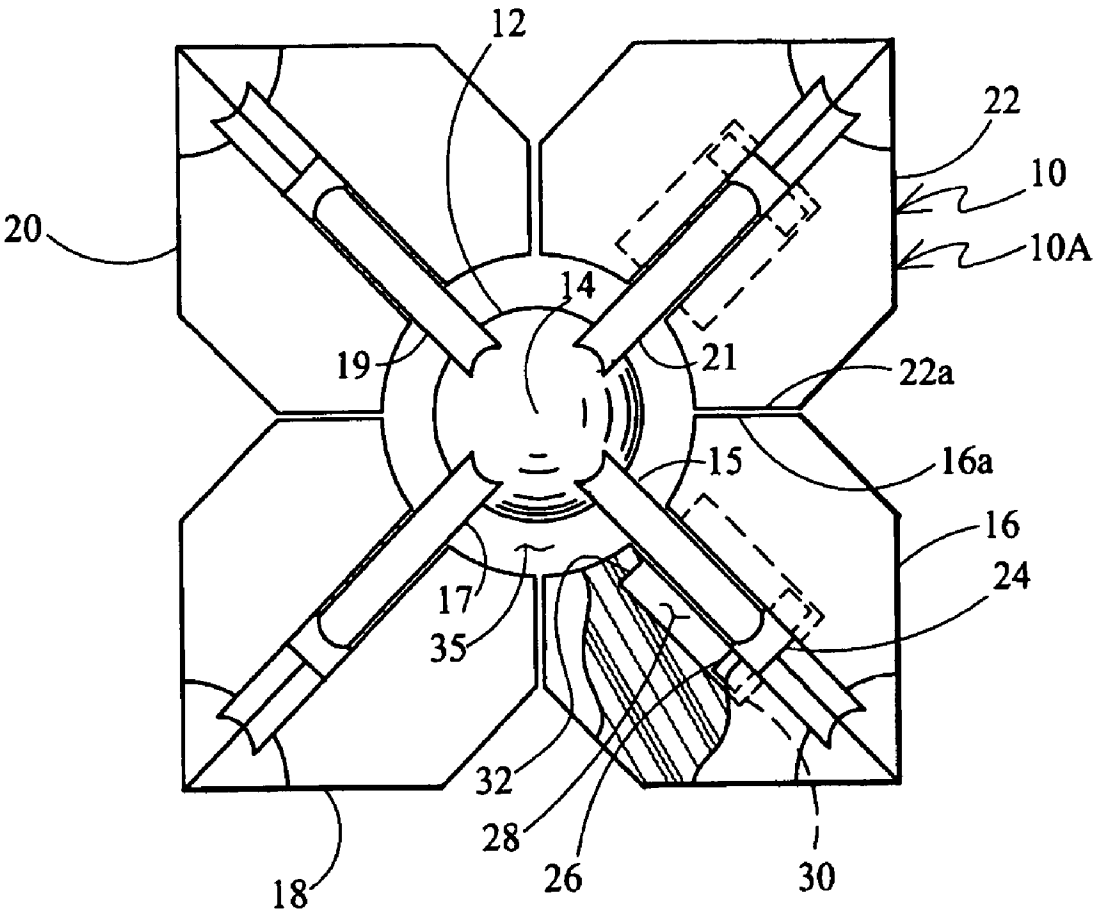
FIG. 1 diagrammatically illustrates a top view of a square kinetic sculptural system (a first inboard compressed mode)

FIG. 1 diagrammatically illustrates a top view of a square kinetic sculptural system.

Figure 2:
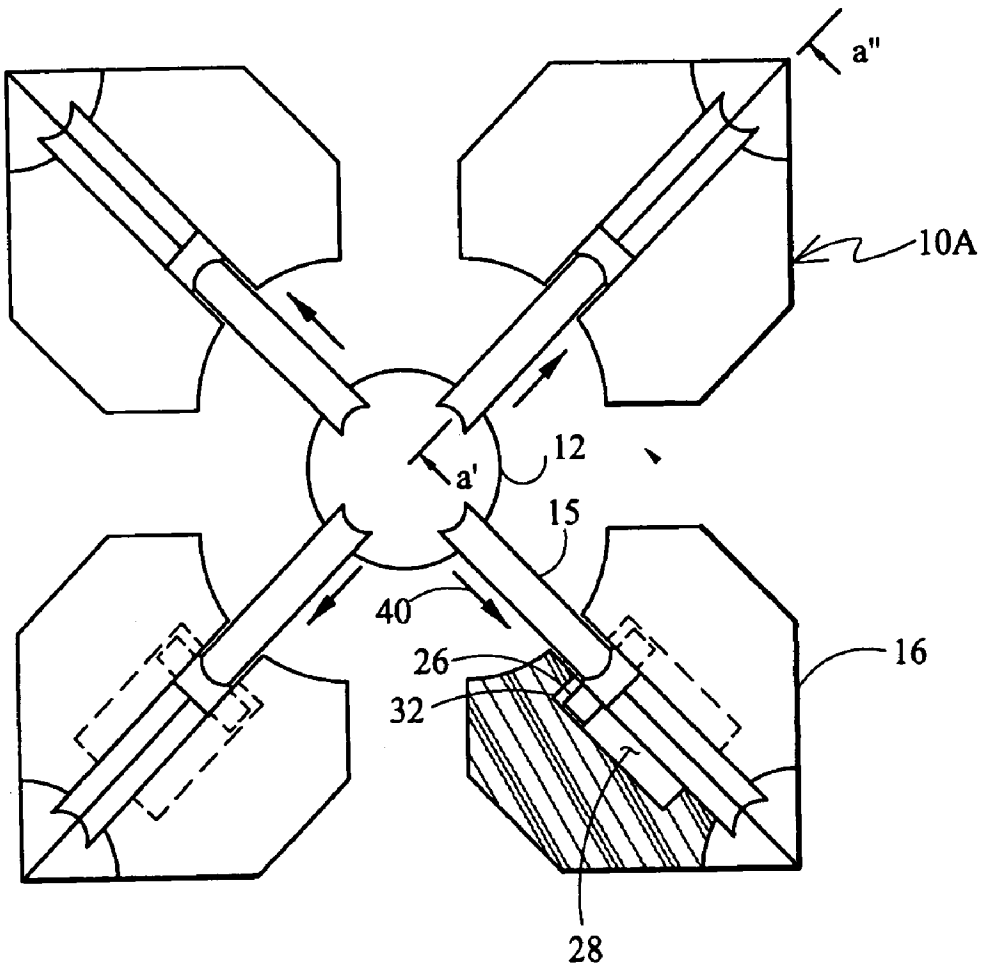
FIG. 2 diagrammatically illustrates a top view of the square kinetic assembly in an expanded mode (the modules moved outboard on the struts)
Figure 11:
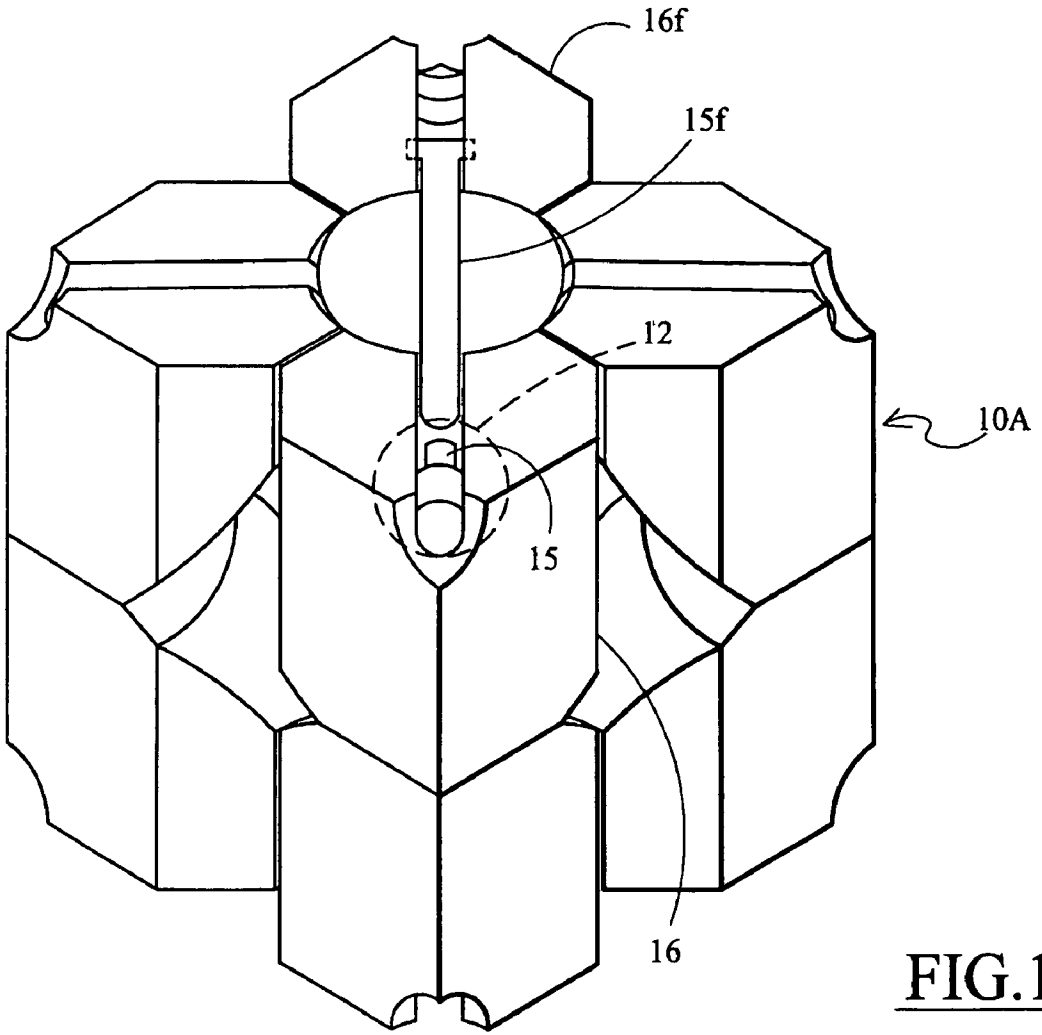
FIG. 11 diagrammatically illustrates the inboard compressed square kinetic structure (perspective view) (the first inboard compressed mode)

FIG. 2 diagrammatically illustrates an expanded version of the square kinetic system. Therefore, FIG. 1 is a first inboard compressed square sculptural system whereas FIG. 2 is a first expanded or outboard sculptural system. As discussed in detail later, each module can be moved radially outward (shown in conjunction with FIGS. 3A-3E) and rotated 180 degrees to form a spheric kinetic sculptural system or assembly shown in FIGS. 4, 5 and 6. A perspective view of the square kinetic assembly is shown in FIG. 11.

FIG. 1 shows kinetic sculptural system 10 configured as an inboard compressed square. FIG. 1 diagrammatically illustrates a top view of the square version of kinetic system 10. System 10 includes a central coupler 12 which, in this embodiment, is formed as a sphere or ball. Other shapes may be used. Central coupler 12 includes a centerpoint 14. Movable modules 16, 18, 20 and 22 are substantially identical in shape and in construction. Each movable module is movably attached with respect to centerpoint 14 and central coupler 12 by a corresponding strut 15, 17, 19 and 21. The modules always move radially on the struts. Since the strut and the movable modules are substantially identical (one strut compared with another strut), reference is made to module 16 and strut 15 in this specification.

Strut 15 is mounted at its proximal end to central coupler 12 and has a distal end 24 with a pivot element 26 thereon. Pivot element 26 is disposed in a radial channel 28 formed in module 16. As discussed later in connection with FIGS. 8A-8E, module 16 is, in this embodiment, a two-piece structure. However, it might be possible to construct module 16 as a single piece provided the pivot element 26 can be disposed in radial channel 28 of module 16. Radial channel 28 has a distal terminus or end 30 and a proximal terminus or end 32. Of course, since module 16 can be rotated 180 degrees, the "proximal" and "distal" designations change. Therefore, distal terminal end 30 is noted in FIG. 1 with the first inboard compressed mode or the square kinetic system. When module 16 is 180 degrees rotated, terminal end 32 is then at a distal position compared to end 30. The square kinetic assembly (the first inboard compressed mode) is referred to herein as kinetic assembly 10A. The spheric or oblong kinetic assembly is referred to as kinetic assembly 10B. As shown in FIG. 11, sphere kinetic assembly 10A utilizes eight modules.

FIG. 2 diagrammatically illustrates the expanded mode of the square kinetic assembly 10A. The movable modules 16 are radially moved outward or outboard by the user as shown by arrow 40 and pivot element 26 of strut 15 is substantially adjacent terminal end 32 of radial channel 28. With reference to FIG. 1, module 16 can be altered in shape to reduce the size of central gap 35. However, this may require a change to interface 22*a* and 16*a*. As shown in FIG. 1, in the inboard compressed mode, all the modules form a first substantially solid body with four of the struts (eight if it is a complete square per FIG. 11) positioned at the first terminus 32 of radial channel 28. The left, right and inboard sides of each module are complementary to the adjacent modules to form the assembly 10A.

Figure 3A:
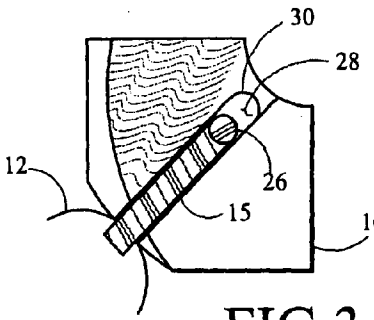
FIGS. 3A-3F diagrammatically illustrate the slotted radial passageway and the rotation of one module on the corresponding strut.
Figure 3B:
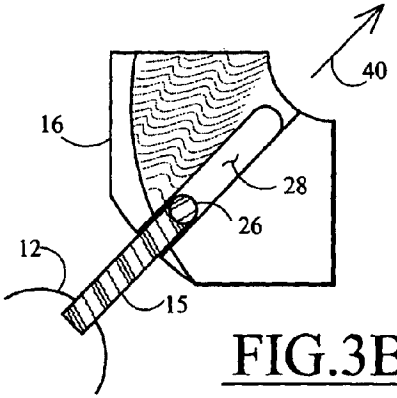
Figure 3C:
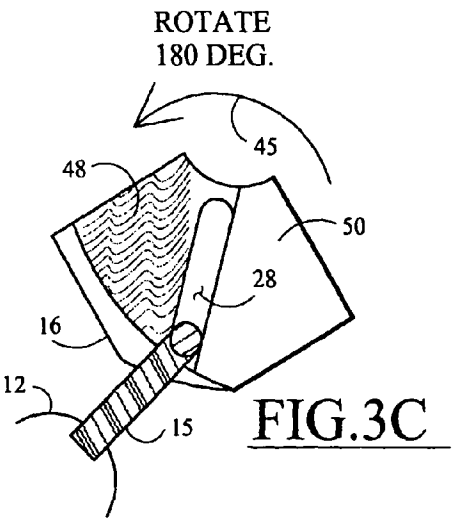
Figure 3D:
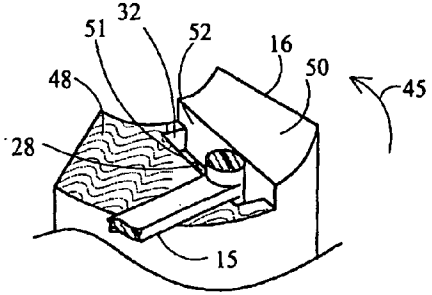

FIGS. 3A, B, C, E and F show a view of the module and struts at cross-section a'-a" of FIG. 2. FIG. 3D is a perspective, broken way view of the module during mid-stroke of the 180 degree travel of the module on the strut.

FIG. 3A diagrammatically illustrates strut 15 and particularly pivot element 26 near terminal end 30 of radial slot 28. To convert the square kinetic assembly 10A to a spherical or oblong assembly, module 16 is moved radially outboard in the direction shown by arrow 40 in FIG. 3B. Due to complementary interfitting sides of adjacent modules, the modules must be moved radially outward to clear the complementary sides and permit 180 degree rotation. At this point, pivot element 26 is preferably near the terminal end 32 of radial channel 28. The module must be radially spaced away from the centerpoint body enough to clear the module from adjacent modules to permit 180 degree rotation. Clearance of each module with respect to the other module also may require full radial extension of each module prior to rotation. When in that outboard position, as shown in FIG. 3C, module 16 is rotated 180 degrees as shown by arrow 45. To accomplish this, each module includes a 180 slotted radial passageway. This 180 degree radial slot or passageway is formed by interior face 48 which is spaced apart from interface 50. As shown in FIGS. 3A-3F, radial slot face 48 is shown slightly shaded. FIG. 3D shows that module 16 rotates with respect to strut 15 180 degrees in the 180 degree radial slot formed partly in part by face 48. Further, radial channel 28 has opposing channel walls 51, 52. Channel wall 52 is co-extensive with one side of the radial slot formed by depressed slot wall face 48. Mechanically, co-extensive wall 52 forms a stop wall at both 180 degree positions thereby limiting the swing of module 16 on strut 15. The radial slot is slightly larger than the lateral span of the strut (normal to the radial length of the strut).

Figure 3F:
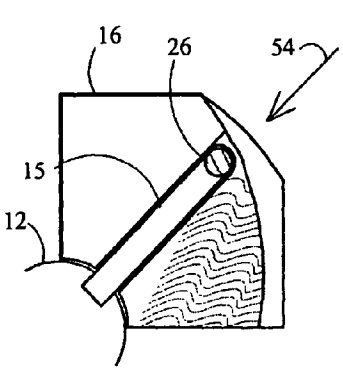
Figure 3E:
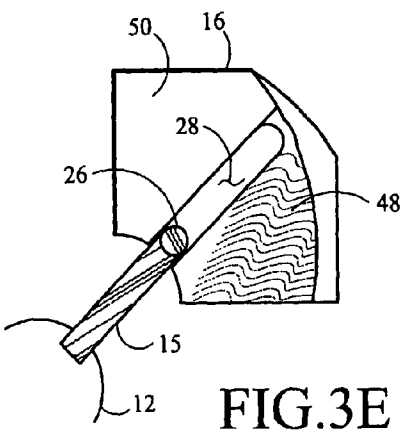

In FIG. 3E, module 16 is completely rotated. In FIG. 3F, module 16 is moved radially inboard as shown by arrow 54.

Figure 4:
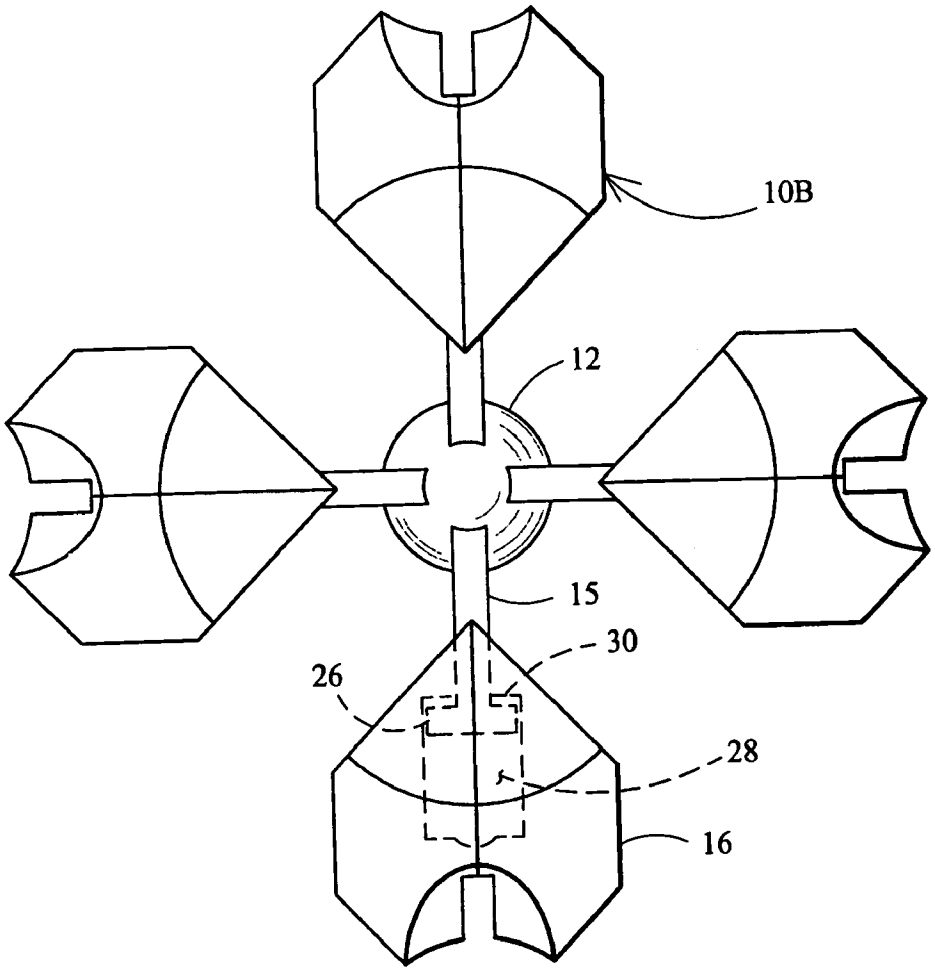
FIG. 4 diagrammatically illustrates an expanded mode of another kinetic structure and, more particularly, a top view of the expanded sphere or oblong kinetic structure or assembly (the second outboard expanded mode)

FIG. 4 diagrammatically illustrates atop view of the expanded sphere kinetic structure 10B. In this configuration, modules 16 are radially outboard of central coupler 12. Pivot element 26 is near or at terminal end 30 of radial channel 28.

Figure 5:
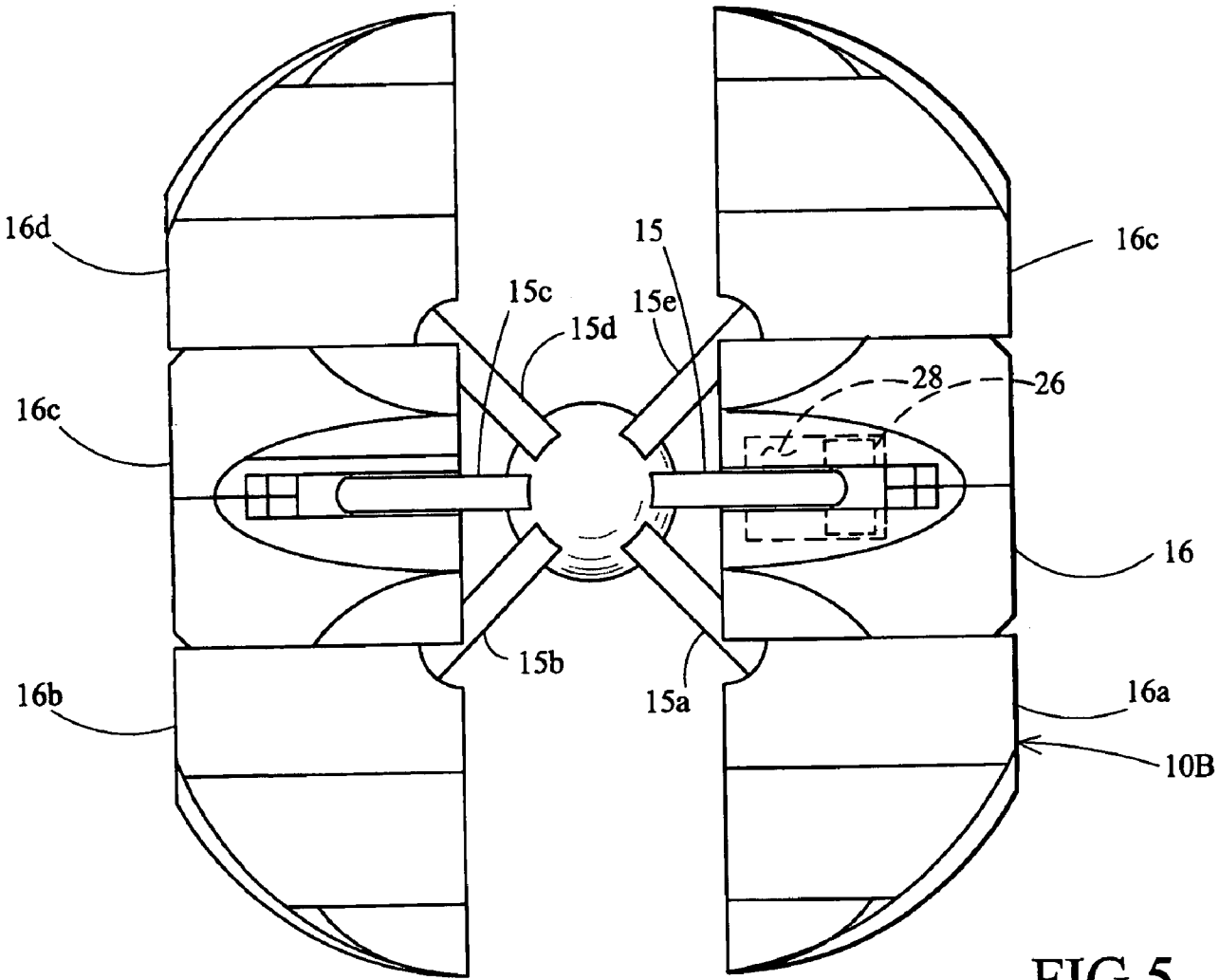
FIG. 5 diagrammatically illustrates the expanded mode of the sphere kinetic sculptural assembly.

FIG. 5 diagrammatically illustrates a side view of the expanded spherical kinetic system 10B. This spherical kinetic system is the outboard second mode or embodiment. Six struts 15, 15A, 15B, 15C, 15D and 15E are shown in FIG. 4. Modules 16, 16A, 16B, 16C, 16D and 16E are shown on respective struts.

Figure 6:
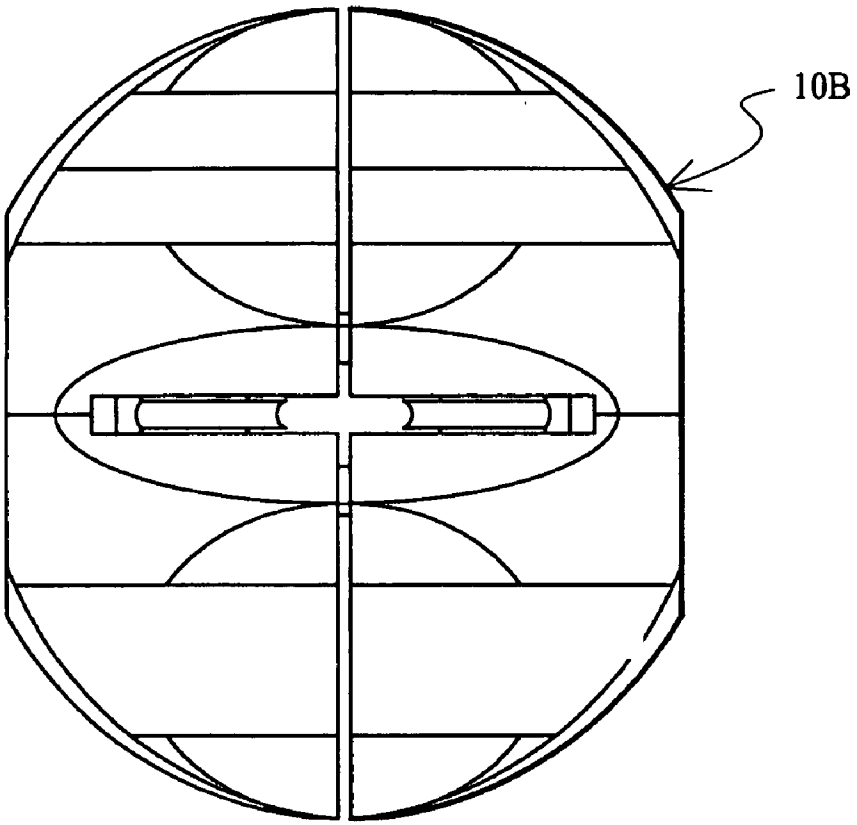
FIG. 6 diagrammatically illustrates the compressed sphere kinetic sculptural assembly (the second inboard compress mode) and, more particularly, a side view of that kinetic sculpture.

FIG. 6 diagrammatically illustrates the second inboard compressed mode or the spherical or oblong kinetic system assembly 10B.

Figure 7C:
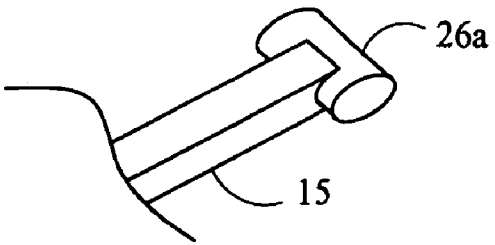
FIGS. 7A-7C diagrammatically illustrate the central coupler.
Figure 7A:
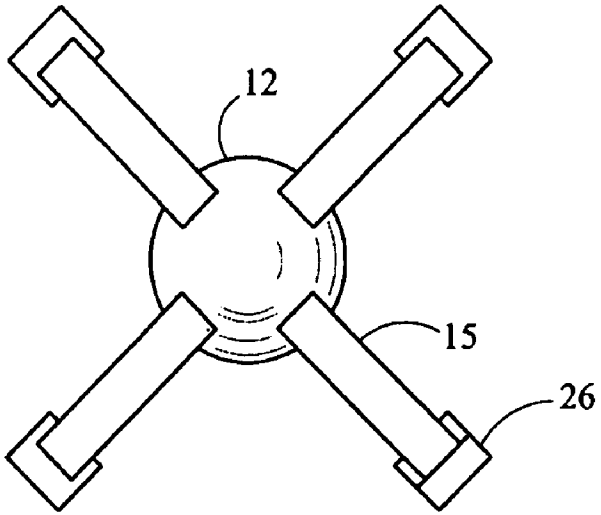
Figure 7B:
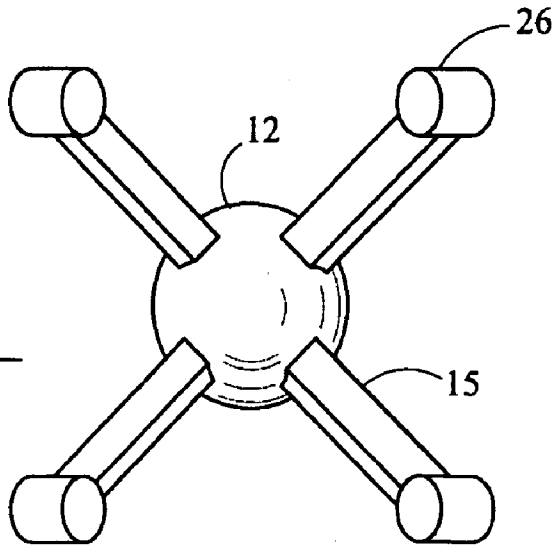

FIG. 7A is a top view of central coupler 12 with four struts 15 spaced 90 degrees apart. As shown in FIG. 7B, the struts extend above a ground plane at a 45 degree angle. Pivot elements 26 are formed on the outboard terminal ends or strut 15. The pivot element 26 can take various constructions such as pivot element 26*a* which as a smooth transition between strut body 15 and the pivot element.

FIG. 7C is a perspective view of central coupler 12.

FIGS. 8A-8E show various aspects of the two piece module 16. In a working embodiment, module 16 includes pieces 70, 72. The module is split down a radial plane. In a working embodiment, modular piece 70 includes a plurality of holes 74 which coact with pins 76 in modular piece 72. Arrows 71 show how modular piece 70 of FIG. 5A interfaces with modular piece 72 of FIG. 8B. The 180 degree radial slot face 48*a* is spaced away from interface surface 50*a*. Further, the 180 radial slot face 48*b* is spaced away from interface surface 50*b* of module piece 72. When module pieces 70, 72 are joined, faces 50A and 50B are substantially adjacent each other whereas radial passage slot face 48*a* is spaced apart from slot face 48*b* a distance slightly greater than the lateral dimension of strut 15. See FIG. 3D. As described earlier, the pivot element 26 of strut 15 moves within radial channel 28. Radial channel 28 is formed by radial channels 28*a* and 28*b* in pieces 70, 72.

Figures 8A, 8B, 8C, 8D, 8E:
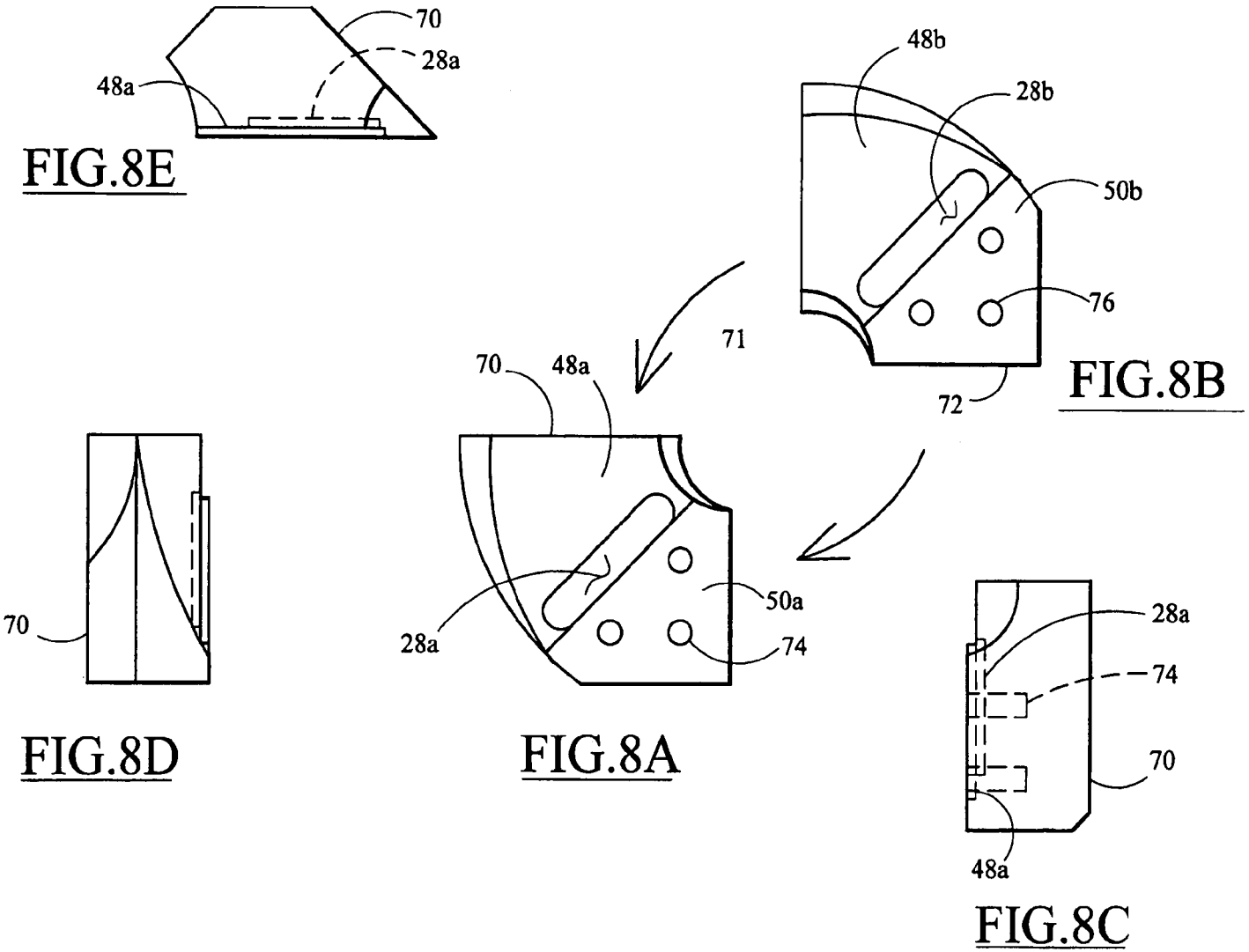
FIGS. 8A-8E diagrammatically illustrate a module.

FIG. 8C shows pin cavities 74 and the bottom of radial slot 28*a* and the 180 radial passageway face 48*a*. FIG. 8D shows another view of modular piece 70, particularly, the spherical front face. FIG. 8E shows a top view of modular piece 70 and radial passageway surface 48*a* and radial channel 28*a*.

Figure 9:
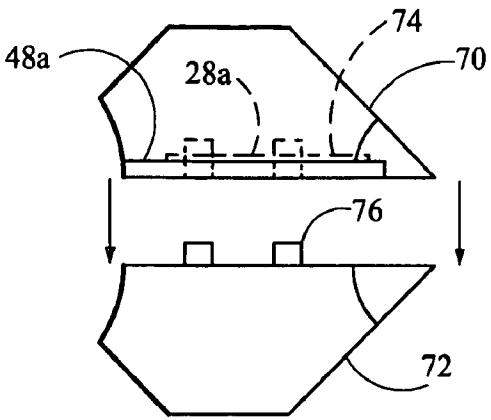
FIG. 9 diagrammatically illustrates a two piece movable module.

FIG. 9 diagrammatically illustrates the interconnect between modular piece 70 and modular piece 72 via pins 76 and pin channels 74. Of course, the pins and pin channels may be replaced by snaps or reasonable friction interfits thereby permitting the kinetic assembly to be configured as a toy or a puzzle.

Figure 10B:
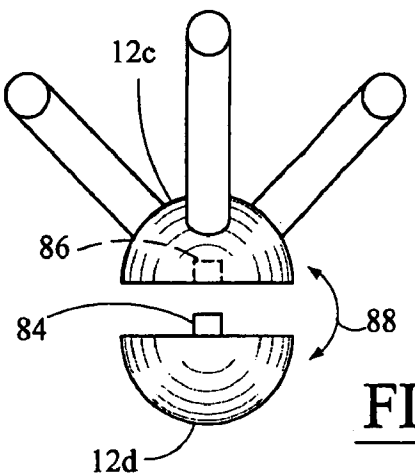
FIGS. 10A and 10B diagrammatically illustrate various constructions of the central coupler.

FIG. 10 diagrammatically illustrates that central coupler 12 can be configured as a two piece coupler 12*a*, 12*b*. Further, FIG. 10 shows that the kinetic system can occupy a hemispheric kinetic assembly rather than a spherical kinetic assembly. In other words, only half of the puzzle or kinetic assembly may be employed. Central coupler pieces 12*a*, 12*b* can be snap fit or friction fit together by pins 11 and pin channels 9. Snaps or other types of detachable interfaces may be utilized. Central coupler 12*a*, 12*b* is attached together as noted by arrows 80. Additionally, the struts may be detachably mounted on central coupler 12 by insertion of strut 15 into passage 8. Strut 15 may be moved in direction 80 into passage 8.

FIG. 10 diagrammatically illustrates central coupler comprising a rotatable coupler section 12C rotatably mounted on coupler section 12D. Pin 84 can be detachably inserted into hole or passageway 86. Central coupler 12C can be rotated in the direction shown by double headed arrow 88 with respect to a fixed central coupler piece 12D.

FIG. 11 diagrammatically illustrates the square kinetic assembly 10A. This is the first inboard compressed mode of kinetic assembly 10. In this configuration, module 16 in is an inboard position on strut 15 close to central coupler 12. The opposing module 16F is in a radially inboard position on strut 15*f*. Strut 15*f* is mounted, either fixed or in a detachable manner, to central coupler 12.

Figure 12:
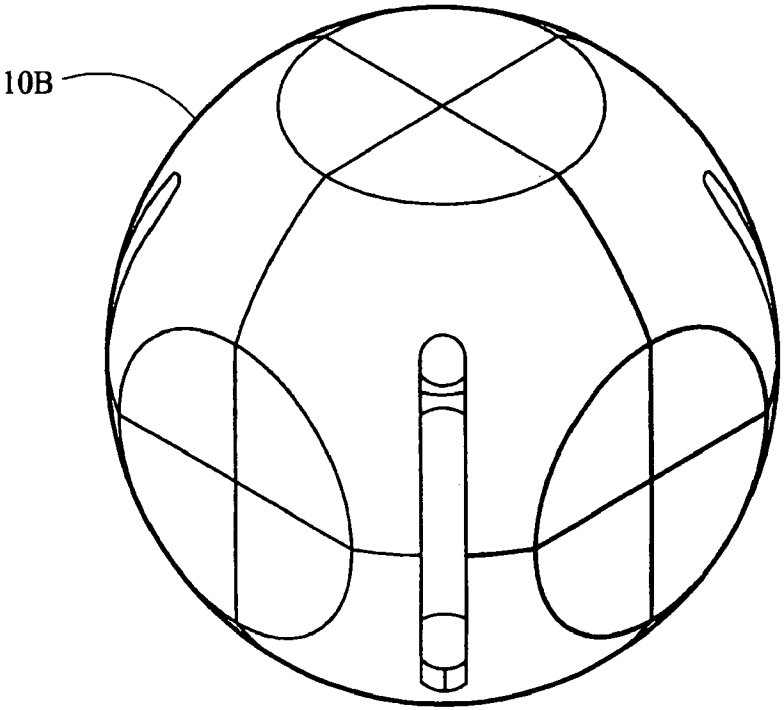
FIG. 12 diagrammatically illustrates an oblong or spheric kinetic sculptural system (a second inboard compressed mode); and, FIG. 13 diagrammatically illustrates a different construction for a half section of the module enabling a different look for the kinetic sculptural system.

FIG. 12 diagrammatically illustrates the second inboard compressed mode or a perspective view of the spherical or oblong kinetic assembly 10B. However, the decorative outside or outboard portions of each module have been altered. Compare FIG. 6 spherical kinetic assembly 10B with FIG. 12 spherical kinetic assembly 10B.

Figure 13:
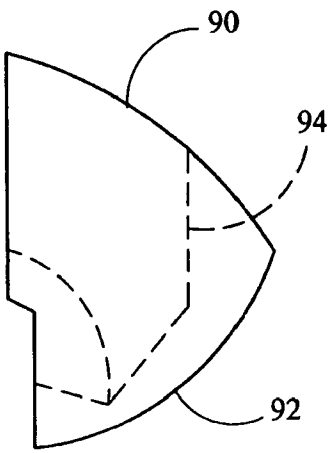

FIG. 13 shows that module 90 has a fill element 92 which is different than the outside module surface 94 shown in broken lines in FIG. 13. Outside module surface 94 is substantially identical to the outside surface of module 16 in FIG. 4. The left and right lateral sides are complementary to the adjacent sides of laterally disposed adjacent modules.

As noted in the above described preferred embodiments, the kinetic structural system can be configured as an eight module system with eight struts and eight modules movable on respective struts. Each of these movable modules has a complementary first inboard shape and a complementary second inboard shape. The complementary first inboard shape of all the modules, when the modules are radially inboard on the struts, form a first inboard compressed mode. The example herein is the square kinetic assembly 10A. By radially expanding the square kinetic assembly 10A into an expanded kinetic assembly and then rotating each module 180 degrees in the 180 degree radial slot passageway, and then moving each module radially inboard toward central coupler 12, a second inboard compressed mode is established. The example herein is the spherical kinetic assembly 10B. For a puzzle, the eight module system has the following pieces:

PIECE TABLE A

| Item | No. Of Pieces |
|---|---|
| center sphere | 2 |
| struts | 8 |
| module block elements 2 × 8 | 16 |
| (optional quarter center sphere) | (+2) |

Figure 10A:
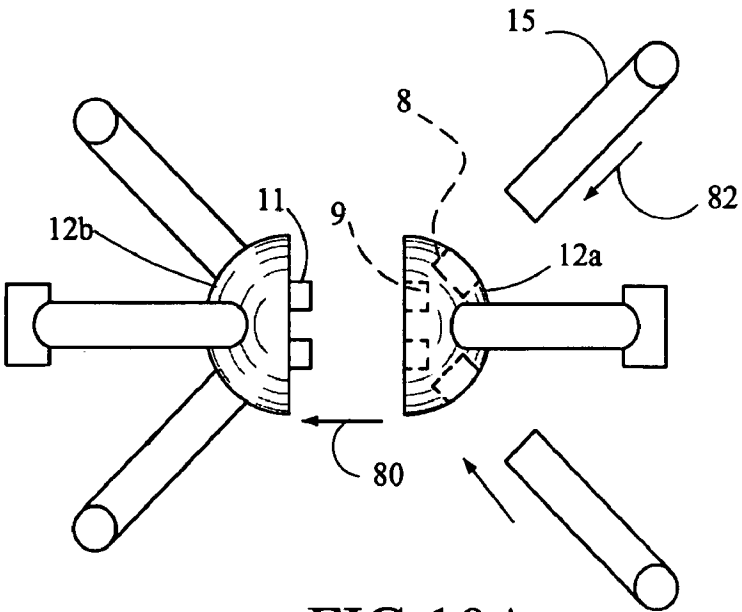

FIG. 10A shows that the central coupler may be a hemispheric element with four struts extending from an imaginary ground plane passing through the centerpoint 14 of the central coupler 12. The struts are positioned 45 degrees above the imaginary ground plane and each strut is 90 degrees apart. In the hemispheric kinetic assembly, four modules move on four struts.

FIG. 10A also shows that the struts may be any number n which is larger than 1 for a hemispheric kinetic assembly. Therefore, n is two or more. In this case, each movable module must have a complementary first inboard shape forming, in a first inboard compressed mode, a substantially solid hemispheric body (n=2) when all n struts are positioned at a first terminus of the respective channel in the respective module. Each module must also include a complementary second inboard shape forming, in a second inboard compressed mode, as substantially solid hemispheric body when the pivot elements of all n struts are positioned at a second terminus of the respective channel in the respective module. For n=2, FIG. 10A would include two struts, each 90 degrees apart and each strut 45 degrees above the ground plane. Any hemispheric body can be doubled to a spheric body.

The claims appended hereto are meant to cover modifications and changes within the scope and spirit of the present invention.

What is claimed is:

1. A kinetic sculptural system of interconnected modules having multiple configurable positions comprising:

a central coupler with a centerpoint;

eight struts mounted on said central coupler at substantially 90 degree angles with respect to each other, each strut having a pivot element at its distal end;

a movable module disposed on each said strut, each module defining a radial channel therein within which is disposed said pivot element of the corresponding strut, said radial channel having opposing channel side walls and an inboard and an outboard terminus, each module defining a slotted radial passageway formed as a substantially 180 degree radial slot extending from one side of said radial channel, said slotted radial passageway permitting substantially complete 180 degree rotation of said corresponding module about the respective strut in a plane passing through said centerpoint when said pivot element is spaced away from said proximal terminus of said radial channel.

2. A kinetic sculptural system as claimed in claim 1 wherein each said module had a cross-sectional dimension, coextensive with said channel radial, which is not longer than the radial dimension of said strut from said centerpoint to a pivot point on said pivot element.

3. A kinetic sculptural system as claimed in claim 1 wherein each module is formed of two segments which two segments interface and are detachably joined together along a radial plane through said module.

4. A kinetic sculptural system as claimed in claim 1 wherein said central coupler is a sphere.

5. A kinetic sculptural system as claimed in claim 4 wherein the central sphere is a plurality of sphere segments all detachably interconnected.

6. A kinetic sculptural system as claimed in claim 4 wherein the central sphere is formed of two rotatably mounted hemispheres.

7. A kinetic sculptural system as claimed in claim 6 wherein said rotatably mounted hemispheres are detachably interconnected.

8. A kinetic sculptural system as claimed in claim 1 wherein said eight struts are eight detachable struts detachably mounted on said central coupler.

9. A kinetic sculptural system as claimed in claim 2 wherein each module is formed of two segments which two segments interface and are detachably joined together along a radial plane through said module.

10. A kinetic sculptural system as claimed in claim 9 wherein said central coupler is a sphere.

11. A kinetic sculptural system as claimed in claim 10 wherein the central sphere is a plurality of sphere segments all detachably interconnected.

12. A kinetic sculptural system as claimed in claim 11 wherein the central sphere is formed of two rotatably mounted hemispheres.

13. A kinetic sculptural system as claimed in claim 12 wherein said rotatably mounted hemispheres are detachably interconnected.

14. A kinetic sculptural system as claimed in claim 13 wherein said eight struts are eight detachable struts detachably mounted on said central coupler.

* * * * *